United States Patent [19]

Cobb

[11] 4,184,808

[45] Jan. 22, 1980

[54] FLUID DRIVEN PUMP

[75] Inventor: Delwin E. Cobb, Peoria, Ill.

[73] Assignee: Caterpillar Tractor Co., Peoria, Ill.

[21] Appl. No.: 849,819

[22] Filed: Nov. 9, 1977

[51] Int. Cl.[2] ..... F04B 17/00; F04B 9/10; F01C 1/18; F03C 3/00

[52] U.S. Cl. ..... 417/348; 417/349; 417/390; 417/405; 418/196

[58] Field of Search ..... 417/348, 349, 375, 390, 417/391, 405, 406; 418/196

[56] References Cited

U.S. PATENT DOCUMENTS

| | | | |
|---|---|---|---|
| 1,460,875 | 7/1923 | White | 418/196 |
| 2,920,814 | 1/1960 | Breelle | 417/348 |
| 3,198,126 | 8/1965 | Minich | 417/348 |
| 3,447,422 | 6/1969 | Bidlack et al. | 418/196 |

*Primary Examiner*—John J. Vrablik

*Attorney, Agent, or Firm*—Charles E. Lanchantin, Jr.

[57] ABSTRACT

A pump has three gears disposed in three cavities of a housing, with the first and second gears being connected and the second and third gears being connected. A pressurized fluid source is connected to the housing for rotating the gears, whereupon fluid is drained into and expelled from housing through a plurality of passages therein.

16 Claims, 5 Drawing Figures

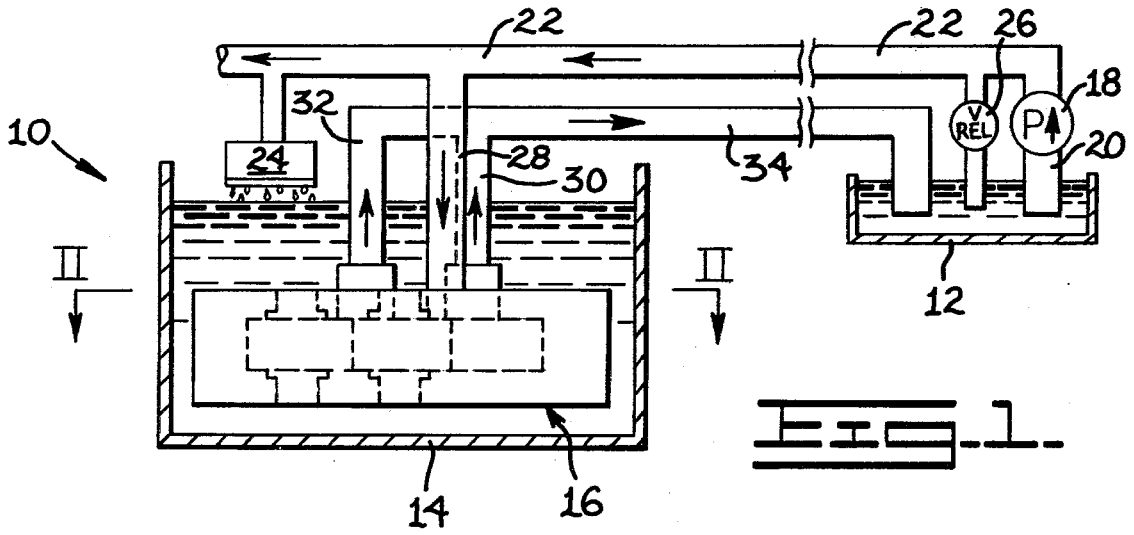
FIG. 1
FIG. 2
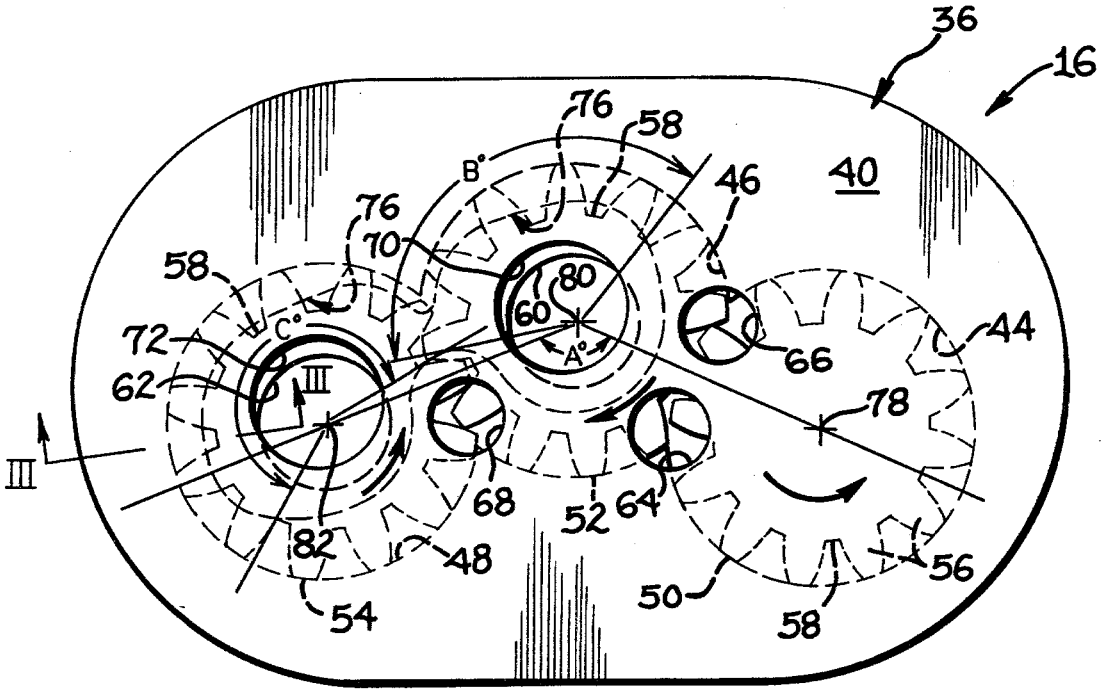

FLUID DRIVEN PUMP

BACKGROUND OF THE INVENTION

The present invention relates to a fluid driven intermeshing gear pump.

Positive displacement pumps having a pair of intermeshing spur gears and at least one mechanically driven gear shaft are well known. However, it is not always economically feasible or convenient to mechanically drive a sump pump, for example, from a remote location.

Double section gear pumps involving back-to-back pairs of gears have been used to avoid an extended mechanical drive mechanism. In such case, one pair of gears acts as a motor in response to receiving a pressurized fluid at the intermesh, while the other pair of juxtaposed gears is mechanically coupled to the first pair and acts as a conventional pump. But in that type of compound pump, there are four gears and associated shafts and housings, and four cavities for the gears which contribute to the overall space requirements, complexity, and expense thereof. This construction is undesirably wasteful of space and materials. In addition, many of these pumps are unsatisfactory in that they pick up and pump an excessive amount of entrained air.

In view of the above, it would be advantageous to provide a compact intermeshing spur gear pump which is fluid driven, low in cost, effective in its operation, and effective to deaerate the fluid being pumped.

SUMMARY OF THE INVENTION

The present invention is directed to overcoming one or more of the problems as set forth above.

According to the present invention this is accomplished by a pump having three gears respectively received in three cavities of a housing, and with the first and second gears being connected and with the second and third gears being connected. The gears are rotated by being in communication with a pressurized fluid source, and fluid is drawn into and expelled from the housing through a plurality of passages therein.

BRIEF DESCRIPTION OF THE DRAWINGS

FIG. 1 is a diagrammatic side elevational view of a fluid control system incorporating the fluid driven pump of the present invention.

FIG. 2 is a diagrammatic and enlarged plan view of the pump as taken along the line II—II of FIG. 1.

DETAILED DESCRIPTION OF THE INVENTION

Figure 3:
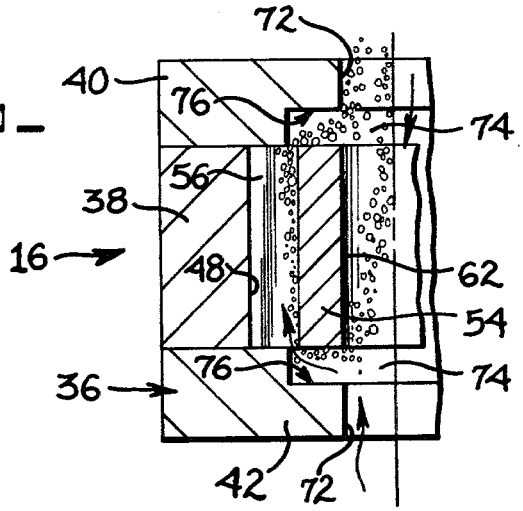
FIG. 3 is a diagrammatic sectional view of the pump as taken along the line III—III of FIG. 2.

Referring to FIG. 1, a fluid control system 10 has first and second fluid sources or reservoirs 12 and 14 respectively. A fluid driven pump 16 constructed in accordance with the present invention is located in the second reservoir or sump 14 and maintains a relatively minimal amount of fluid therein by returning fluid to the remotely disposed primary reservoir 12. An engine driven pump 18 has an inlet conduit 20 leading to the fluid in the primary reservoir and, in use, an outlet conduit or main rail 22 supplies such fluid under pressure to a plurality of components 24 at a preselected pressure to do useful work in accordance with the setting of a relief valve 26, all in a well known manner. A branch conduit 28 is connected between this pressurized main rail and the fluid driven pump 16 to operate it. First and second outlet conduits 30 and 32 also are connected to the pump 16 to permit fluid in the reservoir 14 to be returned to the primary reservoir through the common return conduit 34 in response to operation of the pump 16. In the instant example, as the components 24 are operated fluid emanating therefrom is collected in the second reservoir 14 and must be returned to the remotely located primary reservoir 12.

Turning now to the construction of the fluid driven pump 16, and with reference to FIGS. 2 and 3, it may be noted that such pump includes a housing 36 having a central body portion 38, and an upper closure plate 40 and a lower closure plate 42 on either side of the body portion. First, second and third interconnected cavities 44, 46 and 48 are defined in the body portion of the housing for respectively receiving first, second and third spur gears 50, 52 and 54. While these three gears are similar to each other in that they each have a plurality of teeth 56 and teeth roots 58, the second and third gears differ from the first in respectively having cylindrical passages 60 and 62 therethrough. It is apparent from FIG. 2 that the teeth of the first and second gears are in intermeshing contact intermediate the first and second cavities, and that the teeth of the second and third gears are in intermeshing contact intermediate the second and third cavities.

As shown in FIG. 2, a cylindrical inlet port 64 is defined through the upper closure plate 40 at the point of opening separation of the teeth 56 of the first and second gears 50 and 52. This port is in open communication with the branch conduit 28 shown in FIG. 1, so that it is clear that pressurized fluid from the main rail 22 is always in communication with the pump 16 for continuous operation thereof.

First and second outlet passages 66 and 68 of generally cylindrical construction are also defined through the upper closure plate 40 at the point of closure of the teeth 56 of the first and second gears 50 and 52, and of the teeth of the second and third gears 52 and 54 respectively. These outlet passages are in open communication with the first and second conduits 30 and 32 leading back to the primary reservoir 12.

In order to better draw fluid into the pump 16 from the second reservoir 14, both the upper and lower closure plates 40 and 42 have first and second cylindrical inlet passages 70 and 72 formed therethrough. In each one of the closure plates these two inlet passages are in open communication with a common inlet chamber 74 defined by a circuitous relief slot 76 as is best shown in FIG. 3. The upper and lower inlet passage and relief slots are substantially mirror images of each other, and the central passages 60 and 62 through the gears 52 and 54 permit fluid to freely communicate between the resevoir and the upper and lower inlet chambers 74.

More particularly, each of the cavities 44, 46 and 48 has a central axis 78, 80 and 82 respectively. Advantageously, the gears 50, 52 and 54 are free to float and rotate within these cavities substantially about such axes without the need for any shafts and associated support bearings in the housing. It is contemplated, however, that the usual support shafts could be incorporated if sufficient bearing area is not available on the outer diameter of the gear teeth. The axes 78, 80 and 82 ae purposely arranged so that an included angle A, as is illustrated in FIG. 2, is defined between a pair of planes individually passing through two of them. Preferably such included angle is between 100 degrees and 140 degrees, with about 110 degrees being preferred.

Furthermore, it is to be noted that the upper and lower relief slots 76 are open to the teeth roots 58 of the second and third gears 52 and 54 through preselected angles identified generally by the reference letters B and C respectively. In the case of the second gear the angle B is preferably about 150 degrees from the point of intermeshing opening of the intermeshing teeth 56 to the point where the relief slot is no longer in open communication with the tooth roots of the second gear. In the case of the third gear the angle C is preferably about 210 degrees. With this construction fluid from the reservoir enters near the center of these gears through the inlet passages 70 and 72, and flows radially outwardly so that the pump performs as a centrifugal pump and the fluid is fed to the teeth under pressure. In this regard, it is to be noted in FIG. 2 that the inlet passages are radially displaced or offset towards the central portions of the aforementioned angles B and C to increase the effectiveness of such fluid movement. Furthermore, air is advantageously forced out of the fluid by centrifugal force, which is surprisingly large for this pump. The centrifugal action on the fluid forces the accumulation of air in the tooth roots 58, and subsequently air relief takes place through the same angles B and C, as is generally indicated by the diagrammatically illustrated air bubble path toward the upper part of FIG. 3.

Figure 4:
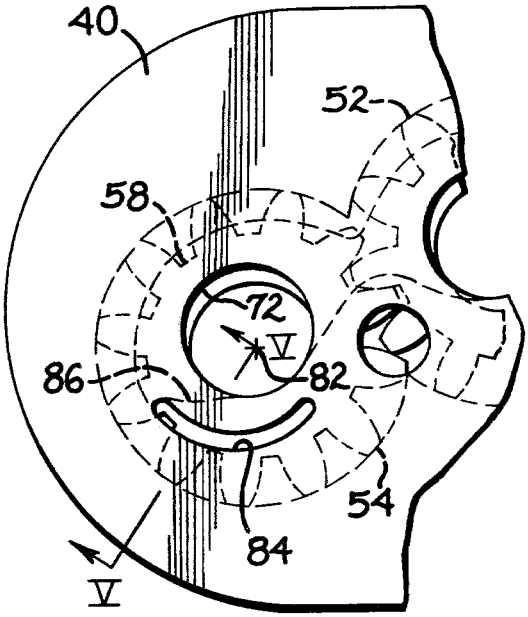
FIG. 4 is a diagrammatic fragmentary plan view of an alternate embodiment pump that may be compared with FIG. 2.
Figure 5:
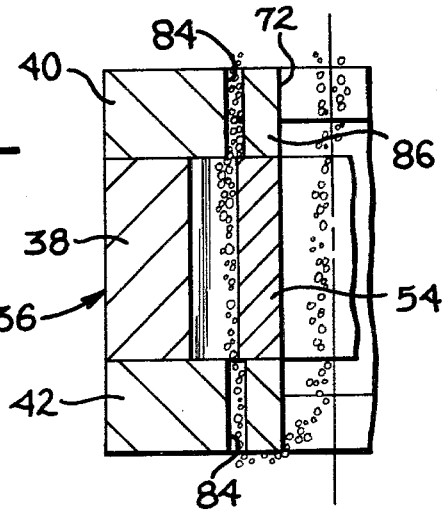
FIG. 5 is a diagrammatic sectional view of the alternate embodiment pump as taken along the line V—V of FIG. 4.

Referring now to FIGS. 4 and 5, on alternate embodiment construction of the upper and lower closure plates 40 and 42 is shown wherein an arcuate air escape port 84 is provided in each plate radially outwardly of the second inlet passage 72, which ports open axially on the teeth roots 58 and the side faces of the gear 54. In addition, arcuate baffle wall means 86 is provided radially inwardly of each of the air escape ports. The air escape ports and baffle wall means are generally C-shaped in construction. With this construction entrained air bubbles in the teeth roots 58 are encouraged to move toward the axis 82 and outwardly from one side of the pump housing 36 with a larger proportion of fluid entering into the bottom of the housing. Although not shown, it is contemplated that similar air escape ports and baffle wall means can be incorporated in the closure plates 40 and 42 adjacent the first inlet passage 70.

In the operation of either embodiment, and as best visualized with respect to FIG. 2, the pressurized fluid entering the inlet port 64 drives the first gear 50 in a counterclockwise direction and the second gear 52 in a clockwise direction, while the third gear 54 is caused to rotate in a counterclockwise direction when viewing the drawing by the teeth intermesh. Since the pump 16 preferably has two first inlet passages 70 and two second inlet passages 72, the fluid level in the reservoir 14 may be low or the reservoir and pump may be angularly inclined and yet the pump will still perform effectively to draw fluid into a single inlet passage opening on the fluid even though the remaining inlet passages are above the fluid level.

In the instant embodiments, the pressure of the fluid being expelled from the first and second outlet passages 66 and 68 advantageously biases the gears 50, 52 and 54 in a radial direction away therefrom. This adds to the smooth increase in pressure in the tooth cavity and flow of air out of the tooth roots 58. The three gears preferably have larger than normal clearances on their sides adjacent the closure plates 40 and 42 to permit relatively large quantities of air of escape to the inlet passages 70 and 72 and the air escape port 84. Since oil, for example, is much more viscous than air, such clearance will still block most of the oil flow. A larger than normal clearance is also preferably provided between the tips of the gears and their respective cavities 44, 46 and 48 in order to allow pressure to build up further circumferentially from the outlet passages 66 and 68.

In view of the foregoing, it is readily apparent that the fluid driven pump of the present invention is simple in construction by having only three floating gears which contributes substantially to its overall compactness. Moreover, it is effective in operation by having four inlet passages so that it can be utilized as a low cost sump pump for a reservoir that is in a remote location on a vehicle or its implement. In such an environment even though the reservoir is angularly inclined the fluid driven pump will perform effectively even though only a single inlet passage is below the fluid level. Entrained air bubbles are expelled by the centrifugal action of the pump and the movement of such air bubbles outwardly of the pump housing is enhanced by air escape port and baffle means provided for such purpose so that substantially only a deaerated fluid is communicated away therefrom.

Other aspects, objects and advantages will become apparent from a study of the specification, drawings and appended claims.

The embodiments of the invention in which an exclusive property or privilege is claimed are defined as follows:

1. A fluid driven pump comprising:

a housing defining first, second and third cavities and an inlet port located intermediate said first and second cavities;

first, second and third spur gears each having a plurality of external gear teeth and each positioned in a respective one of the cavities, said first and second spur gears being rotatably connected one to the other and said second and third spur gears being rotatably connected one to the other;

fluid means connected to said housing at said inlet port for solely rotating said first and second spur gears at the point of opening separation of said gear teeth of said first and second spur gears, said third spur gear being driven by said second spur gear; and passage means in said housing for drawing a fluid into said housing and expelling said fluid from said housing in response to intermeshing rotation of said spur gears.

2. The pump of claim 1 wherein said housing includes a central body portion and a closure member on each side of said central body portion and said passage means includes a first inlet passage defined in one of said closure members and located at said second cavity and a second inlet passage defined in said one of said closure members and located at said third cavity.

3. The pump of claim 1 wherein said housing includes a central body portion and a closure member on each side of said central body portion and said passage means includes a first outlet passage defined in one of said closure members and located intermediate said first and second cavities and a second outlet passage defined in said one of said closure members and located intermediate said second and third cavities.

4. The pump of claim 1 wherein said third gear has a plurality of teeth roots, and said pump includes an air escape port in said housing opening on said teeth roots.

5. The pump of claim 4 wherein said passage means includes an inlet passage in said housing, and said pump includes baffle wall means intermediate said inlet passage and said air escape port for promoting the escape of a plurality of entrained air bubbles from said fluid.

6. A fluid driven pump comprising:

a housing defining first, second and third cavities;

first, second and third gears each having a plurality of teeth roots and each positioned in a respective cavity, said first and second gears being rotatably connected one to the other and said second and third gears being rotatably connected one to the other;

fluid means connected to said housing for rotating said gears; and passage means in said housing for drawing a fluid into said housing and expelling said fluid from said housing in response to intermeshing rotation of said gears, said passage means including a common inlet chamber located at said second and third cavities and opening on said teeth ports of said second and third gears.

7. A fluid driven pump conprising:

a housing defining first, second and third cavities, said housing including a central body portion and a closure plate on each side of said central body portion;

first, second and third gears each positioned in a respective cavity, said first and second gears being rotatably connected one to the other and said second and third gears being rotatably connected one to the other;

fluid means connected to said housing for rotating said gears; and passage means in said housing for drawing a fluid into said housing and expelling said fluid from said housing in response to intermeshing rotation of said gears, said passage means including a pair of inlet passages in each of said closure plates, two of said inlet passages opening on said second cavity and two of said inlet passages opening on said third cavity.

8. The pump of claim 7 wherein each of said second and third gears has a central passage in communication with respective pairs of said inlet passages.

9. The pump of claim 7 wherein said inlet passages in one of said closure plates are associated with a relief slot of preselected geometric configuration relative to said second and third gears.

10. The pump of claim 9 including an arcuate air escape port in one of said closure plates radially spaced from one of said inlet passages.

11. A fluid driven pump comprising:

a housing defining first, second and third cavities, first, second and third inlet passages, and a pair of outlet passages in communication with said cavities;

first, second and third spur gears each having a plurality of external gear teeth and each being respectively received in said cavities and rotatable therein, said first and second spur gears being connected and said second and third spur gears being connected; and means connected to said first inlet passage for supplying a pressurized fluid to said housing and solely rotating said first and second spur gears, said second and third spur gears drawing additional fluid into said housing through said second and third inlet passages and expelling said fluids through said outlet passages.

12. The pump of claim 11 wherein said pair of outlet passages are generally cylindrical in construction and are respectively located intermediate said first and second spur gears at the point of intermeshing closure of said gear teeth thereof and intermediate said second and third spur gears at the point of intermeshing closure of said gear teeth thereof.

13. The pump of claim 11 including a relief slot of preselected geometric configuration formed in said housing common to and opening on said second and third gears and said second and third inlet passages.

14. A fluid driven pump comprising:

a housing defining first, second and third cavities, first, second, third, fourth and fifth inlet passages, and a pair of outlet passages in communication with said cavities;

first, second and third gears respectively received in said cavities and rotatable therein, said first and second gears being connected and said second and third gears being connected, said second and third gears having second and third axes respectively, said fourth and fifth inlet passages communicating with said cavities at said second and third axes respectively, said fourth inlet passage being substantially opposite said second inlet passage and said fifth inlet passage being substantially opposite said third inlet passage; and means connected to said first inlet passage for supplying a pressurized fluid to said housing and solely rotating said first and second gears, said second and third gears drawing additional fluid into said housing through said second and third inlet passages and expelling said fluids through said outlet passages.

15. The pump of claim 14 wherein said second and third gears have a central passage therethrough respectively communicating said second and fourth inlet passages and said third and fifth inlet passages.

16. A fluid driven pump comprising:

a housing defining first, second and third cavities, a pressurized inlet passage opening on said first and second cavities, a pair of suction inlet passages opening individually on said second and third cavities, and a pair of outlet passages opening individually intermediate said first and second cavities and intermediate said second and third cavities; and first, second and third spur gears each having a plurality of external gear teeth and each being received in said respective first, second and third cavities and rotatable therein, said first and second spur gears being intermeshed and solely driven in response to fluid flow into said inlet passage, and said third spur gear being intermeshed with and solely driven by said second spur gear.

* * * * *